US009592982B2

(12) United States Patent
Higuchi

(10) Patent No.: US 9,592,982 B2
(45) Date of Patent: Mar. 14, 2017

(54) MEDIUM DETECTION MECHANISM, MEDIUM DETECTION METHOD, AND PRINTING APPARATUS

(71) Applicant: SEIKO EPSON CORPORATION, Tokyo (JP)

(72) Inventor: Koji Higuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/867,982

(22) Filed: Sep. 28, 2015

(65) Prior Publication Data

US 2016/0090255 A1 Mar. 31, 2016

(30) Foreign Application Priority Data

Sep. 26, 2014 (JP) ..... 2014-196233
Jun. 22, 2015 (JP) ..... 2015-124484

(51) Int. Cl.

| | |
|---|---|
| ***B65H 7/14*** | (2006.01) |
| ***B65H 7/04*** | (2006.01) |
| ***B65H 43/02*** | (2006.01) |
| ***B65H 1/02*** | (2006.01) |

(52) U.S. Cl.

CPC ..... *B65H 7/14* (2013.01); *B65H 1/02* (2013.01); *B65H 7/04* (2013.01); *B65H 43/02* (2013.01); *B65H 2553/414* (2013.01); *B65H 2553/46* (2013.01); *B65H 2801/12* (2013.01)

(58) Field of Classification Search

CPC ..... B65H 7/14; B65H 2553/414; B65H 7/04; B65H 43/02

See application file for complete search history.

(56) References Cited

U.S. PATENT DOCUMENTS 5,139,339 A * 8/1992 Courtney ..... B41J 11/009 250/341.8
5,751,443 A * 5/1998 Borton ..... G03G 15/65 356/446
6,794,669 B2 * 9/2004 Chelvayohan ..... B41J 11/0095 250/559.16
7,205,561 B2 * 4/2007 Chelvayohan ..... B41J 11/0095 250/559.16

FOREIGN PATENT DOCUMENTS

JP 2000-289888 10/2000
JP 2003-040487 2/2003
JP 2004010297 A * 1/2004
JP 2009-263126 11/2009
JP 2009269752 A * 11/2009

* cited by examiner

*Primary Examiner* — Luis A Gonzalez
(74) *Attorney, Agent, or Firm* — Workman Nydegger

(57) ABSTRACT

A medium detection mechanism includes a medium guide that holds a medium and an optical sensor including an irradiation section that emits irradiation light to the medium guide and a light receiving section that receives reflected light. An amount of received light that is received by the light receiving section from among reflected light of external light that enters the medium guide and reflected light of the irradiation light is smaller than or equal to a predetermined value.

11 Claims, 9 Drawing Sheets

MEDIUM DETECTION MECHANISM, MEDIUM DETECTION METHOD, AND PRINTING APPARATUS

BACKGROUND

1. Technical Field

The present invention relates to a medium detection mechanism, a medium detection method, and a printing apparatus including a medium detection mechanism.

2. Related Art

A medium detection mechanism has been known which detects a medium by using an optical sensor including an irradiation section that emits light and a light receiving section that receives light in a printing apparatus such as a printer. In the medium detection mechanism, irradiation light is irradiated from the irradiation section, reflected light that is reflected by the medium or a surface of a medium guide that holds the medium is received by the light receiving section, and the presence or absence of the medium is detected by using the amount of received light. JP-A-2009-263126 discloses an image forming apparatus including an image reading apparatus (a medium detection mechanism) that detects the presence of a document (a medium). In the image reading apparatus, emboss processing is applied to a surface by which light emitted from a light emitting section is reflected, and detection accuracy of a document is improved by reducing the reflected light that goes to a light receiving section when there is no document.

However, the medium detection mechanism described in JP-A-2009-263126 is assumed to be used in a scanner section of a copy machine or the like into which no external light enters. When the medium detection mechanism is provided to, for example, a medium supply mechanism of a printing apparatus including an automatic sheet feeder exposed to outside, reflected light of external light such as illumination reaches a light receiving section of an optical sensor and detection accuracy of a medium on which an image or the like will be printed decreases, so that there is a problem that it is erroneously determined that there is a medium even though no medium is held by a medium guide.

SUMMARY

An advantage of some aspects of the invention can be realized as the following application examples:

APPLICATION EXAMPLE 1

A medium detection mechanism according to the present application example includes a medium guide that holds a medium and an optical sensor including an irradiation section that emits irradiation light to the medium guide and a light receiving section that receives reflected light. An amount of received light that is received by the light receiving section from among reflected light of external light that enters the medium guide and reflected light of the irradiation light is smaller than or equal to a predetermined value.

According to the present application example, the medium detection mechanism emits the irradiation light from the irradiation section to the medium guide, receives reflected light that is reflected by the medium held by the medium guide or a surface of the medium guide by using the light receiving section, and detects the presence or absence of the medium according to the amount of received light. The medium detection mechanism is configured so that the amount of received light is smaller than or equal to a predetermined value even when the external light and the irradiation light enter and are reflected by the surface of the medium guide and the reflected light is received by the light receiving section, so that it is possible to prevent a medium from being erroneously detected in a state in which no medium is held by the medium guide. Therefore, it is possible to provide the medium detection mechanism where the detection accuracy of the medium is improved.

APPLICATION EXAMPLE 2

In the medium detection mechanism described in the above application example, it is preferable that an area where the medium guide is irradiated with the irradiation light and the external light is a glossy surface.

According to the present application example, the surface of the medium guide is a glossy surface where gloss processing is applied. The irradiation light or the external light incident onto the glossy surface is strongly reflected as regular reflected light, so that the amount of received light that is received by the light receiving section decreases and therefore it is possible to improve detection accuracy of the medium.

APPLICATION EXAMPLE 3

In the medium detection mechanism described in the above application examples, it is preferable that the amount of received light that is received by the light receiving section when the medium is held by the medium guide is greater than that when the medium is not held by the medium guide.

According to the present application example, the medium detection mechanism emits the irradiation light from the irradiation section to the medium guide, receives reflected light that is reflected by the medium held by the medium guide or the surface of the medium guide by using the light receiving section, and detects the presence or absence of the medium according to the amount of received light. It is possible to correctly detect the presence or absence of the medium by setting a predetermined value, which is a threshold value for determining the presence or absence of the medium, between the amount of light received when the medium is not held and the amount of light received when the medium is held.

APPLICATION EXAMPLE 4

It is preferable that the medium detection mechanism described in the above application examples further includes a housing and regular reflected light of the irradiation light irradiated to the medium guide is not emitted to outside of the housing.

According to the present application example, the medium detection mechanism is provided with an optical sensor at a position where the regular reflected light of the irradiation light that is irradiated from the irradiation section to the medium guide is not emitted to the outside of the housing. In other words, when an optical sensor where the irradiation section and the light receiving section are integrally formed is used, regular reflected light of external light entering toward the medium guide in the housing is not received by the light receiving section. Thereby, in a state in which the medium is not held by the medium guide, it is possible to prevent the medium from being erroneously detected due to the regular reflected light of external light.

APPLICATION EXAMPLE 5

In the medium detection mechanism described in the above application examples, it is preferable that the housing covers the optical sensor and at least a part of the medium guide.

According to the present application example, the optical sensor and a part of the medium guide are covered by the housing, so that external light is difficult to enter into the housing. Thereby, in a state in which the medium is not held by the medium guide, the amount of received light that is received by the light receiving section reduces due to the diffused reflected light of external light which is reflected by the medium guide, so that it is possible to improve the detection accuracy of the medium.

APPLICATION EXAMPLE 6

A printing apparatus according to the present application example includes the medium detection mechanism described in any one of the above application examples.

According to the present application example, the printing apparatus includes the medium detection mechanism where the detection accuracy of the medium is improved, so that it is possible to provide the printing apparatus where the detection accuracy of the medium is improved.

APPLICATION EXAMPLE 7

A medium detection method according to the present application example is a medium detection method of the medium detection mechanism described in any one of the above application examples. The medium detection method includes an irradiation process in which the irradiation light is irradiated from the irradiation section, a light receiving process in which the light receiving section receives the reflected light, a processing process in which the output from the light receiving section is processed, and a determination process in which the presence or absence of the medium is determined.

According to the present application example, the medium detection method emits the irradiation light from the irradiation section of the optical sensor to the medium guide that holds the medium, receives reflected light that is reflected by the medium guide or the medium held by the medium guide by using the light receiving section, and obtains the amount of received light that is received by the light receiving section. Then, the amount of received light and a predetermined value that is a threshold value to determine the presence or absence of the medium are compared. When the amount of received light is greater than the predetermined value, it is determined that "there is a medium", and when the amount of received light is smaller than or equal to the predetermined value, it is determined that "there is no medium". The medium detection mechanism is configured so that the amount of received light is smaller than or equal to a predetermined value even when the external light and the irradiation light enter and are reflected by the surface of the medium guide and the reflected light is received by the light receiving section. Thereby, even when the external light enters in a state in which the medium is not held by the medium guide, it is correctly determined that "there is no medium" in the medium detection method of the present application example. Therefore, it is possible to provide the medium detection method where the detection accuracy of the medium is improved.

BRIEF DESCRIPTION OF THE DRAWINGS

The invention will be described with reference to the accompanying drawings, wherein like numbers reference like elements.

DESCRIPTION OF EXEMPLARY EMBODIMENT

Figure 1:
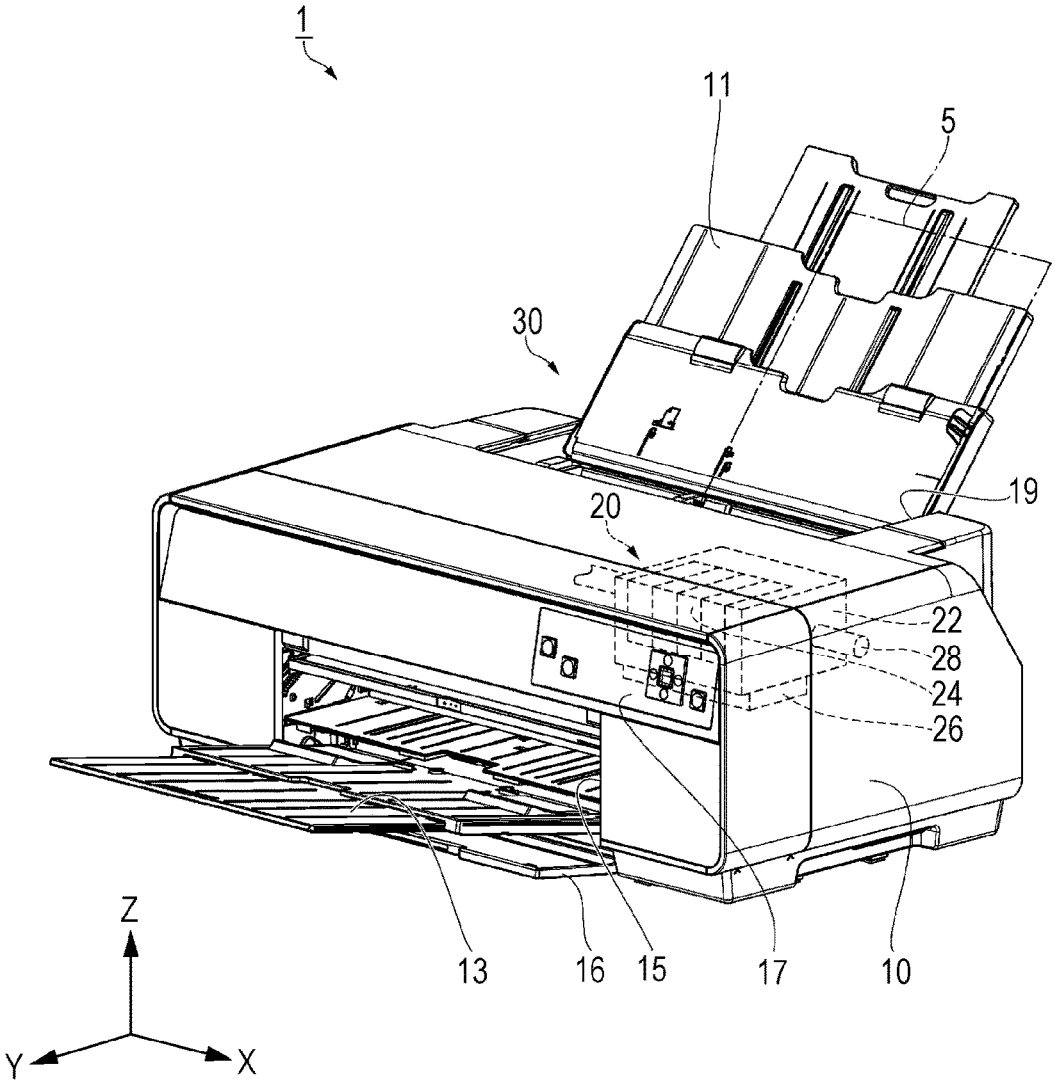
FIG. 1 is a perspective view showing a schematic configuration of a printing apparatus including a medium detection mechanism according to an embodiment.

Hereinafter, an embodiment of the invention will be described with reference to the drawings. In the drawings described below, scales of each layer and each member are differentiated from actual scales so that each layer and each member have recognizable sizes. In FIGS. 1 to 3 and 9, for convenience of description, an X axis, a Y axis, and a Z axis are shown as three axes perpendicular to each other. The distal end side of arrows indicating the axis directions is defined as "+ side" and the base end side of these arrows is defined as "− side". Hereinafter, a direction in parallel with the X axis is referred to as an "X axis direction" or a "main scanning direction", a direction in parallel with the Y axis is referred to as a "Y axis direction" or a "sub-scanning direction", and a direction in parallel with the Z axis is referred to as a "Z axis direction". A side surface as seen from +Y axis side is defined as a "front surface" and the opposite side is defined as a "rear surface".

Embodiment

Schematic Configuration of Printing Apparatus

FIG. 1 is a perspective view showing a schematic configuration of a printing apparatus 1 including a medium detection mechanism 50 according to an embodiment. First, the schematic configuration of the printing apparatus 1 according to the embodiment will be described with reference to FIG. 1.

As shown in FIG. 1, the printing apparatus 1 includes an apparatus main body 10 having an approximately rectangular parallelepiped shape extending along the X axis direction and a medium supply mechanism 30 that feeds a medium 5 into the inside of the apparatus main body 10 from the rear surface of the apparatus main body 10. The medium supply mechanism 30 has an opening space, into which the medium 5 is inserted, as an insertion slot 19. On the rear surface side of the insertion slot 19, a plate-shaped medium support 11 that supports a rear surface of the medium 5 inserted into the insertion slot 19 is extendably provided according to the size of the medium 5. The medium support 11 is connected turnably around inner walls of ±X axis sides of the insertion slot 19 as turning fulcrums. When no medium 5 is supplied, the insertion slot 19 is closed by shortening and turning the medium support 11 so that foreign objects such as dust do not enter the insertion port 19.

On the front surface side of the apparatus main body 10, an operation panel 17 including a plurality of operation buttons and a discharge port 15 from which the medium 5 on which an image or the like is printed is discharged are provided. On the bottom surface side (−Z axis side) of the discharge port 15, a plate-shaped medium tray 13 that supports the discharged medium 5 is extendably provided on the front surface side (+Y axis side) according to the size of the medium 5. When no printing is performed, the medium tray 13 is stored in an inner bottom portion (the bottom surface on the −Z axis side) of the discharge port 15 and the discharge port 15 is closed by a cover 16 that is connected turnably around inner wall bottom portions of ±X axis sides of the discharge port 15 as turning fulcrums.

Inside the apparatus main body 10, a guide shaft 28 is installed and a recording section 20 that performs recording on the medium 5 is provided. The recording section 20 includes an ink tank 24 that stores ink and a recording head 26 that records an image or the like on the medium 5. Specifically, the guide shaft 28 extends in the main scanning direction (±X axis direction) that crosses the sub-scanning direction (+Y axis direction) in which the medium 5 is transported. A carriage 22 is provided movably along the guide shaft 28 at a position facing a transport path 27 (see FIG. 3) of the medium 5 in the recording section 20 in the apparatus main body 10. The carriage 22 reciprocates in the main scanning direction according to driving of a carriage motor (not shown in the drawings).

The ink tank 24 that stores liquid ink of cyan, magenta, yellow, black, and the like is provided at an upper portion (+Z axis side) of the carriage 22. The recording head 26, in which nozzles that discharge ink supplied from the ink tank 24 as liquid droplets to the medium 5 are formed, is provided on a lower surface (a surface in the −Z axis side) of the carriage 22.

When the operation panel 17 is operated, the medium 5 is fed from the medium supply mechanism 30 and is transported to the recording section 20. In the recording section 20, the carriage motor is driven and the recording head 26 reciprocates along with the carriage 22 in the main scanning direction along the guide shaft 28 while discharging the ink from the nozzles to the medium 5, and the medium 5 is transported in the sub-scanning direction along the transport path 27. Thereby, an image or the like is recorded on the medium 5. The medium 5 is transported to the discharge port 15, and the medium 5 on which the image or the like is recorded is discharged from the discharge port 15 and is accumulated on the medium tray 13. The recording section 20 is provided with a control section (not shown in the drawings) that controls the operations described above.

Configuration of Medium Supply Mechanism

Figure 2:
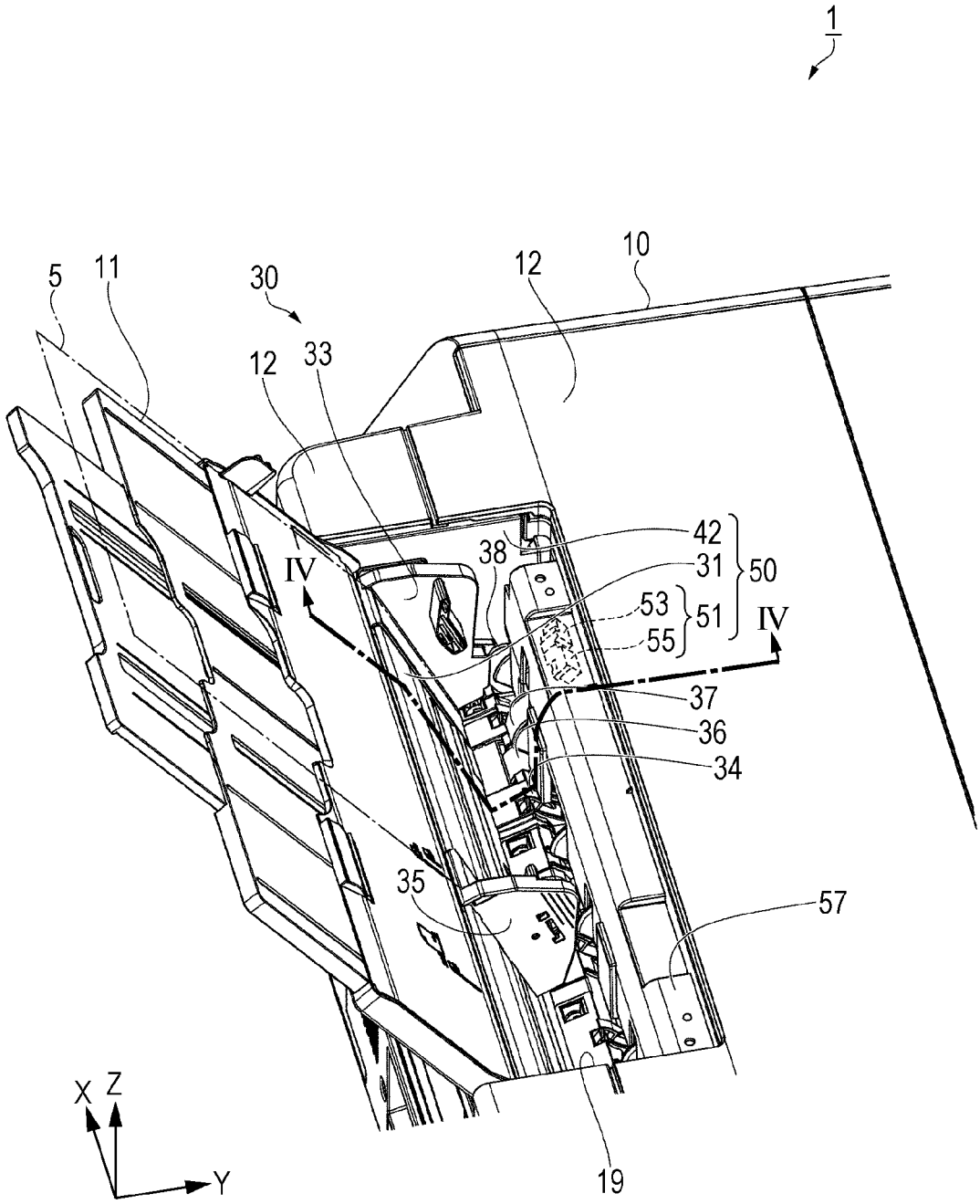
FIG. 2 an enlarged perspective view of a paper feed section in FIG. 1.
Figure 3:
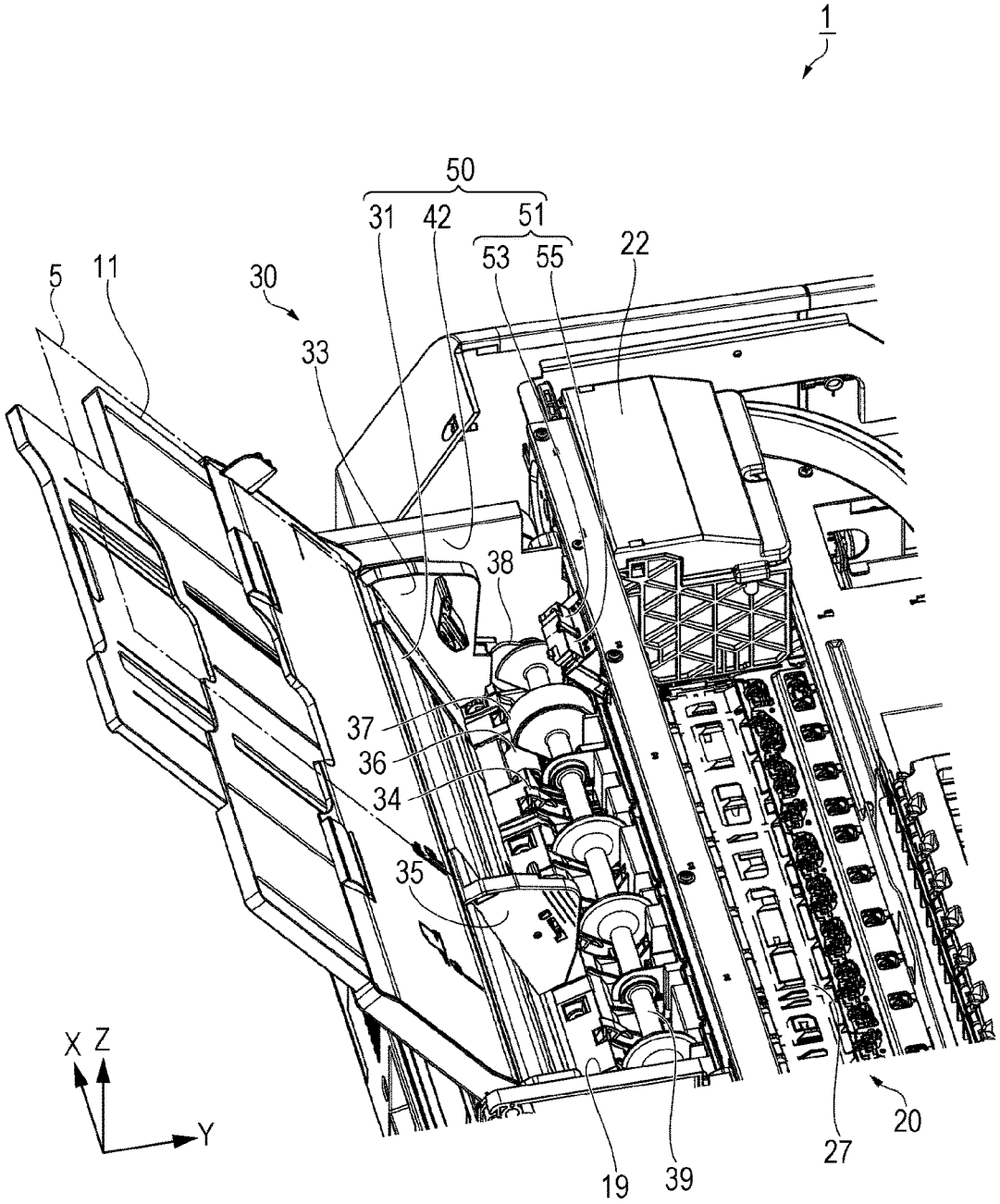
FIG. 3 a perspective view seeing through a housing in FIG. 2.

FIG. 2 an enlarged perspective view showing the medium supply mechanism 30 in FIG. 1. FIG. 3 a perspective view seeing through an upper cover 12 and a light-shielding cover 57 in FIG. 2. A schematic configuration of the medium supply mechanism 30 will be described with reference to FIGS. 2 and 3. The printing apparatus 1 of the embodiment includes a so-called automatic sheet feeder that feeds one by one a plurality of media 5 stacked on a medium guide 31 described later to the recording section 20.

As shown in FIGS. 2 and 3, the medium supply mechanism 30 includes the medium guide 31 that holds the medium 5 inserted from the insertion port 19, a rotation shaft 39, and a feed roller 37 and a cam 38 which rotate integrally with the rotation shaft 39. The medium guide 31 is provided with a fixed type edge guide 33 on the side surface of the medium guide 31 on the +X axis side and a moving type edge guide 35 that is movable in the main scanning direction (±X axis direction). Both ends of the medium 5 in the X axis direction are controlled at predetermined positions by the fixed type edge guide 33 and the moving type edge guide 35, and the medium 5 is held by the medium guide 31.

The upper end (+Z axis side) of the medium guide 31 is connected swingably around an inner wall of the housing 42 in the X axis direction as a fulcrum. The medium guide 31 is swung between a hopper up state in which a lower portion (—Z axis side) of the medium guide 31 approaches the feed roller 37 and a hopper down state in which the lower portion of the medium guide 31 goes away from the feed roller 37 by the cam 38 that rotates integrally with the rotation shaft 39.

The media 5 stacked on the medium guide 31 are pressed onto the feed roller 37 in the hopper up state. When the feed roller 37 is rotated once while the media 5 are pressed onto the feed roller 37, a medium 5 is fed from the medium supply mechanism 30 to the recording section 20 and is transported in the sub-scanning direction along the transport path 27. Specifically, the feed roller 37 is provided in a downstream portion in a feeding direction (+Y axis direction) of the medium guide 31. A separation roller 36 urged to the feed roller 37 by a spring member (not shown in the drawings) is provided below the feed roller 37 in the —Z axis direction.

When one medium 5 is pinched between the separation roller 36 and the feed roller 37, the separation roller 36 is driven to rotate with the feed roller 37 and the one medium 5 is fed to the recording section 20. When a plurality of media 5 are pinched between the separation roller 36 and the feed roller 37, the separation roller 36 is not driven to rotate with the feed roller 37. Therefore, the uppermost medium 5 pressed onto the feed roller 37 is fed to the recording section 20, and the media 5 other than the uppermost medium 5 are not fed to the recording section 20. The media 5 that are not fed to the recording section 20 are pushed back toward the medium guide 31 by a medium return lever 34. Thereby, the plurality of media 5 held by the medium guide 31 are fed one by one to the recording section 20.

The printing apparatus 1 has the medium detection mechanism 50. The medium detection mechanism 50 includes the medium guide 31 that holds a medium and a reflection type optical sensor 51 including an irradiation section 53 that emits irradiation light to the medium guide 31 and a light receiving section 55 that receives reflected light. A part of the optical sensor 51 is covered by the light-shielding cover 57. The medium detection mechanism 50 includes the housing 42 and is provided inside the housing 42 along with the medium supply mechanism 30. In the embodiment, the optical sensor 51 where the irradiation section 53 and the light receiving section 55 are integrally formed is used.

Medium Detection Mechanism

Figure 4:
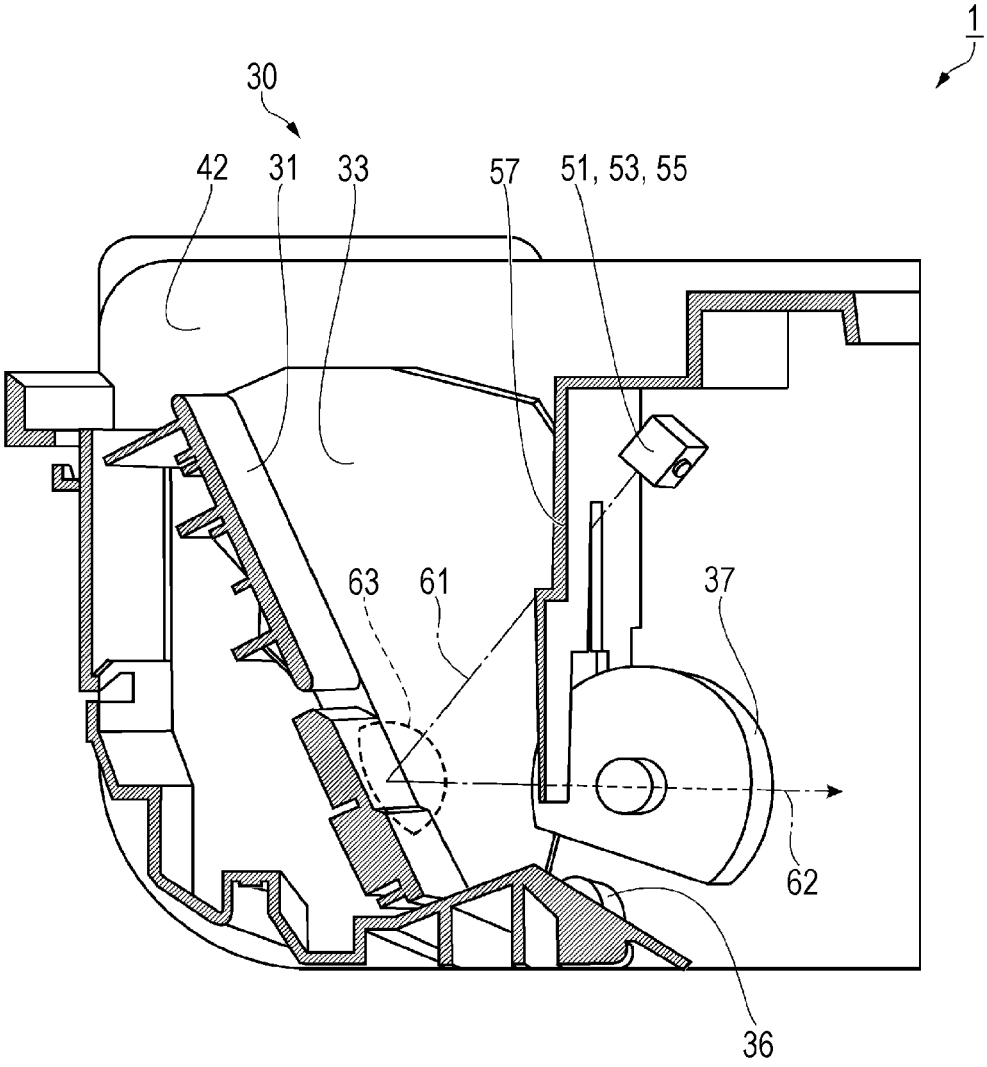
FIG. 4 is a cross-sectional view taken along line IV-IV in FIG. 2.
Figure 5A:
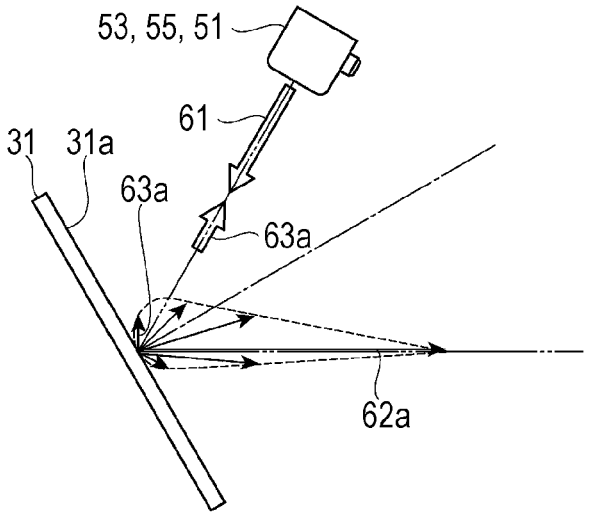
FIGS. 5A to 5C are conceptual diagrams showing a relationship between illumination light and reflected light.
Figure 5B:
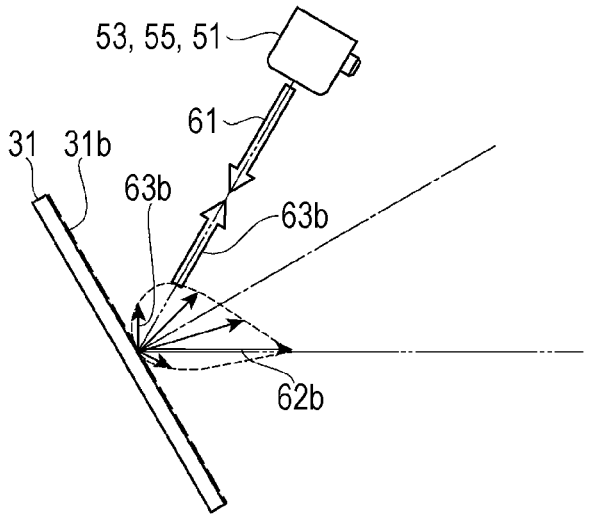
Figure 5C:
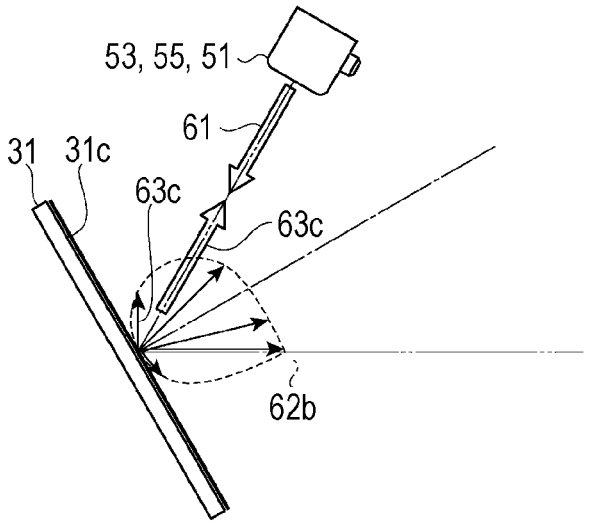

FIG. 4 is a cross-sectional view taken along line IV-IV in FIG. 2. FIGS. 5A to 5C are conceptual diagrams showing a relationship between illumination light and reflected light. The medium supply mechanism 50 will be described with reference to FIGS. 4 and 5A to 5C. FIG. 4 omits the medium support 11. In FIGS. 4 and 5A to 5C, images of the irradiation light and the reflected light are represented by dot and dash lines.

As shown in FIG. 4, the irradiation light 61 emitted from the irradiation section 53 of the optical sensor 51 passes through a slit provided in the light-shielding cover 57, irradiates the medium guide 31, and is reflected and converted by the medium guide 31 into reflected light of diffused reflected light 63 having a reflection peak in a direction of regular reflected light 62.

Here, the irradiation light 61 irradiated from the irradiation section 53 of the optical sensor 51, and the regular reflected light 62 and the diffused reflected light 63 of the irradiation section 53 will be described with reference to FIGS. 5A to 5C. As shown in FIGS. 5A and 5B, the irradiation light 61 irradiated from the irradiation section 53 of the optical sensor 51 is reflected by the medium guide 31 and is converted into regular reflected light 62*a* and 62*b* and diffused reflected light 63*a* and 63*b*. FIG. 5A shows a case in which the irradiation light 61 is irradiated to a glossy surface 31*a* where gloss processing is applied to a surface of the medium guide 31. FIG. 5B shows a case in which the irradiation light 61 is irradiated to an embossed surface 31*b* where small unevenness is formed on the surface of the medium guide 31. The lengths of arrows indicating the irradiation light 61, the regular reflected light 62*a* and 62*b* and the diffused reflected light 63*a* and 63*b* represent the amount of light (energy).

The glossy surface 31*a* has a surface shape flatter than that of the embossed surface 31*b*, so that the irradiation light 61 irradiated from the irradiation section 53 to the glossy surface 31*a* is reflected as the regular reflected light 62*a* whose energy of light is stronger than that of the regular reflected light 62*b* reflected by the embossed surface 31*b*. On the other hand, the embossed surface 31*b* has a surface shape rougher than that of the glossy surface 31*a*, so that the irradiation light 61 irradiated from the irradiation section 53 to the embossed surface 31*b* is reflected as the diffused reflected light 63*b* whose energy of light is stronger than that of the diffused reflected light 63*a* reflected by the glossy surface 31*a*.

FIG. 5C shows an appearance of the light reflected by the surface 31*c* of the medium 5. A surface 31*c* of the medium 5 is closer to a uniform reflecting diffuser than the embossed surface 31*b*, so that the irradiation light 61 irradiated from the irradiation section 53 to the surface 31*c* of the medium 5 held by the medium guide 31 is reflected as diffused reflected light (hereinafter referred to as medium diffused reflected light 63*c*) which is reflected from the surface of the medium 5 and whose energy of light is stronger than that of the diffused reflected light 63*b* reflected by the embossed surface 31*b*.

The characteristics of the uniform reflecting diffuser increase in order from the glossy surface 31*a*, the embossed surface 31*b*, and the surface 31*c* of the medium 5, so that the energy of light (the amount of light) of the diffused reflected light 63 is as follows: medium diffused reflected light 63*c*>diffused reflected light 63*b*>diffused reflected light 63*a*. The light receiving section 55 of the optical sensor 51 of the embodiment receives the diffused reflected light 63 and detects the presence of the medium 5. The amount of received light that is received by the light receiving section 55 when the medium 5 is held by the medium guide 31 is greater than that when the medium 5 is not held by the medium guide 31. Therefore, it is possible to detect the presence of the medium 5 by setting a predetermined value to be a threshold value between the amount of received light of the medium diffused reflected light 63*c* and the amount of received light of the diffused reflected light 63*b* and determining whether or not the amount of received light that is received by the light receiving section 55 is greater than the predetermined value. Specifically, the medium detection mechanism 50 determines that "there is a medium" when the amount of received light that is received by the light receiving section 55 is greater than the predetermined value and determines that "there is no medium" when the amount of received light that is received by the light receiving section 55 is smaller than or equal to the predetermined value. Preferably, a material (resin or the like) of dark color such as black is used as the medium guide. Thereby, it is possible to increase the light amount difference between the light amount of the reflected light that is reflected by the surface of the medium guide and the light amount of the reflected light that is reflected by the surface of the medium, so that it is possible to improve the detection accuracy of the medium.

Let us return to FIG. 4. The configuration of the medium detection mechanism 50 will be described. The regular reflected light 62 of the irradiation light 61 irradiated to the medium guide 31 is not emitted to the outside of the housing 42. Specifically, the optical sensor 51 of the embodiment is installed at an angle of about 50 degrees from the horizontal direction to the −Z axis direction and the irradiation light 61 is irradiated to the medium guide 31 at an angle of about +23 degrees from the vertical direction with respect to the surface of the medium guide 31. Thereby, the regular reflected light 62 reflected by the surface of the medium guide 31 is reflected to the inner direction of the housing 42 and attenuates soon. In other words, when the optical sensor 51 where the irradiation section 53 and the light receiving section 55 are integrally formed is used, regular reflected light of external light entering from the outside of the housing 42 is not received by the light receiving section 55. Therefore, the amount of received light that is received by the light receiving section 55 by the regular reflected light of external light entering the medium guide 31 that does not hold the medium 5 is smaller than or equal to a predetermined value, so that it is correctly determined that "there is no medium". In the embodiment, although the optical sensor 51 where the irradiation section 53 and the light receiving section 55 are integrally formed is exemplified, the optical sensor is not limited to this. It is possible to use an optical sensor where the irradiation section 53 and the light receiving section 55 are separated from each other and to install the light receiving section 55 at a position where the regular reflected light of external light is not received.

Figure 6A:
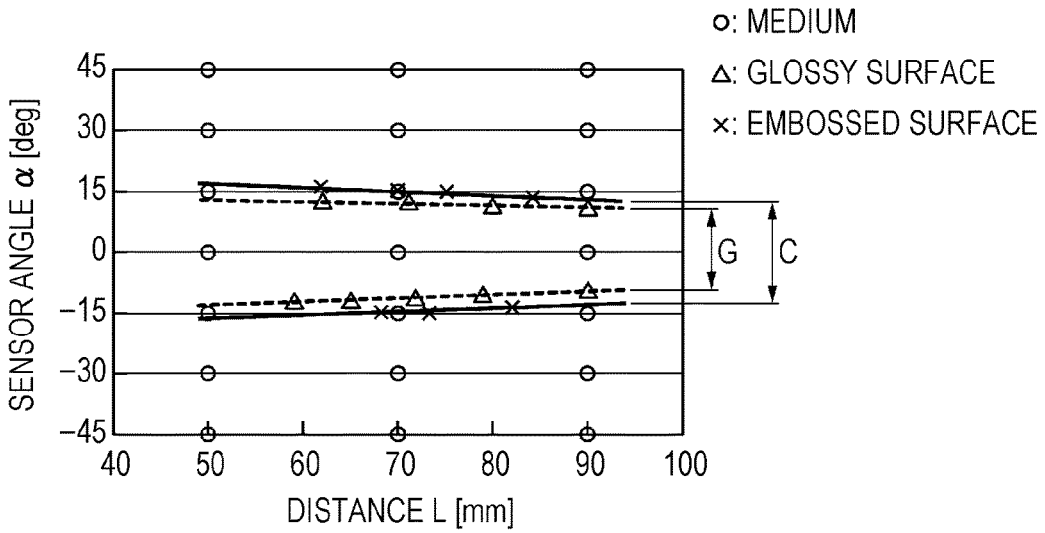
FIGS. 6A and 6B are diagrams showing a detection area of a medium and a medium guide.
Figure 6B:
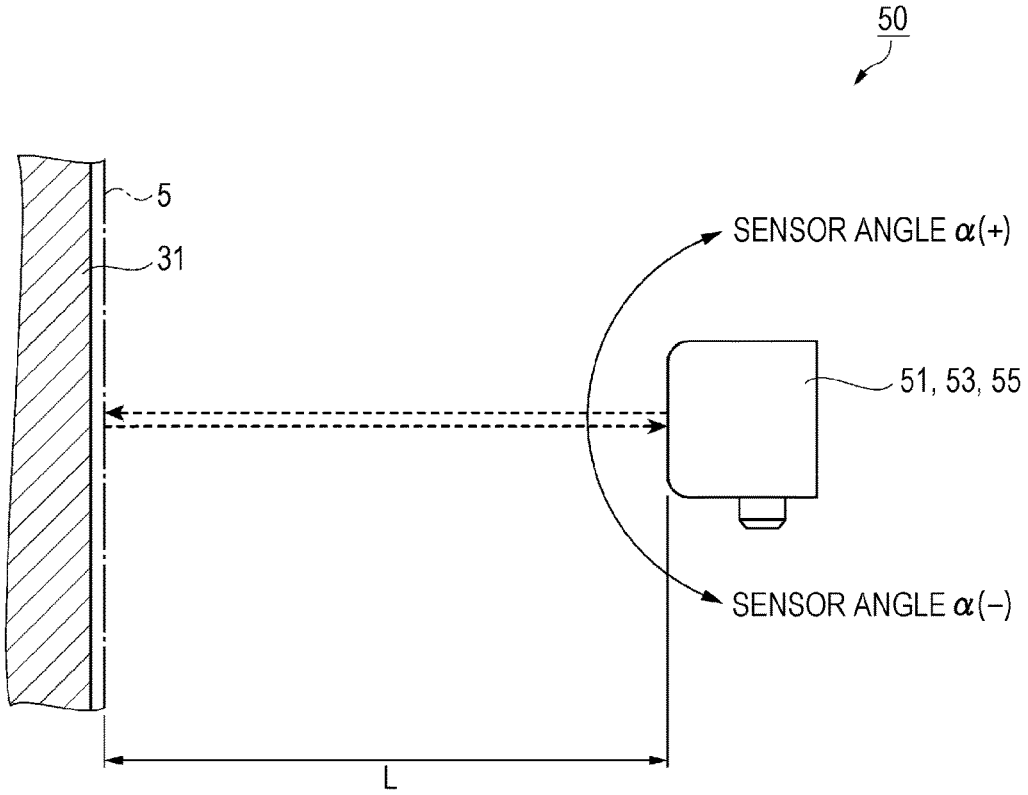

Next, a detection area of the medium detection mechanism 50 will be described. FIGS. 6A and 6B are diagrams showing a detection area of the medium 5 and the medium guide 31. The installation condition of the optical sensor 51 and the detection accuracy of the medium 5 will be described with reference to FIGS. 5A to 5C, 6A, and 6B.

FIG. 6A is a diagram in which, in the configuration of the medium supply mechanism 30 shown in FIG. 2, an area where the optical sensor 51 correctly detects the medium 5 and an area where the optical sensor 51 wrongly detects the medium guide 31 that does not hold the medium 5 as "there is a medium" are obtained by using a distance L between the optical sensor 51 and the medium guide 31 or the medium 5 and a sensor angle $\alpha$ of the optical sensor 51 with respect to the medium guide 31 or the medium 5 as parameters. FIG. 6B is a diagram schematically showing a positional relationship between the medium guide 31 or the medium 5 and the optical sensor 51.

In FIG. 6B, for ease of description, the medium guide 31 or the medium 5 is shown vertically, and the optical sensor 51 is shown in the horizontal direction (perpendicular to the surface of the medium guide 31). The distance L represents an interval between the medium guide 31 or the medium 5 and the optical sensor 51. The sensor angle α represents an angle when the optical sensor 51 is tilted from the horizontal direction to the vertical direction. For example, when the sensor angle α=−30°, the irradiation light 61 is irradiated to the surface of the medium guide 31 at an angle of +30° from the horizontal direction with respect to the surface of the medium guide 31.

The medium detection mechanism 50 determines that "there is a medium" when the amount of received light that is received by the light receiving section 55 is greater than a predetermined value. The amount of light of the medium diffused reflected light 63*c* that is reflected by the surface of the medium 5 is greater than that of the diffused reflected light 63*a* or 63*b* that is reflected by the glossy surface 31*a* or the embossed surface 31*b*, so that the predetermined value is set so that the medium diffused reflected light 63*c* is detected in the entire area. Therefore, when the medium 5 is held by the medium guide 31 and the surface of the medium 5 is irradiated with the irradiation light 61, the medium 5 is detected as "there is a medium" in the entire area shown in FIG. 6A.

When the medium 5 is not held by the medium guide 31, the amount of received light should be smaller than the predetermined value and it should be determined that "there is no medium". However, when the sensor angle α of the optical sensor 51 is close to α=0°, the regular reflected light 62*a* or 62*b* whose amount of light is greater than that of the medium diffused reflected light 63*c* is received by the light receiving section 55, so that the amount of received light exceeds the predetermined value and it is erroneously determined that "there is a medium" even though the medium 5 is not held. An area G indicates a range where it is erroneously determined that "there is a medium" when the glossy surface 31*a* of the medium guide 31 is irradiated with the irradiation light 61. An area C indicates a range where it is erroneously determined that "there is a medium" when the embossed surface 31*b* of the medium guide 31 is irradiated with the irradiation light 61.

As shown in FIG. 6A, the area G where it is erroneously determined that "there is a medium" in the glossy surface 31*a* is smaller than the area C where it is erroneously determined that "there is a medium" in the embossed surface 31*b*, so that it is known that it is possible to improve the detection accuracy of the medium by employing the glossy surface 31*a* as the surface of the medium guide 31. Therefore, in the medium guide 31 of the embodiment, gloss processing is applied to an area where the irradiation light 61 is irradiated to the medium guide 31.

Further, when the glossy surface 31*a* is also employed in an area where the medium guide 31 is irradiated with external light, the amount of light of the diffused reflected light that is generated by the external light reflected by the glossy surface 31*a* of the medium guide 31 decreases, so that it is possible to reduce the amount of received light that is received by the light receiving section 55 by the diffused reflected light of the external light that enters the medium guide 31 to be smaller than a predetermined value. Thereby, the medium 5 is correctly detected.

Electrical Configuration of Printing Apparatus

Figure 7:
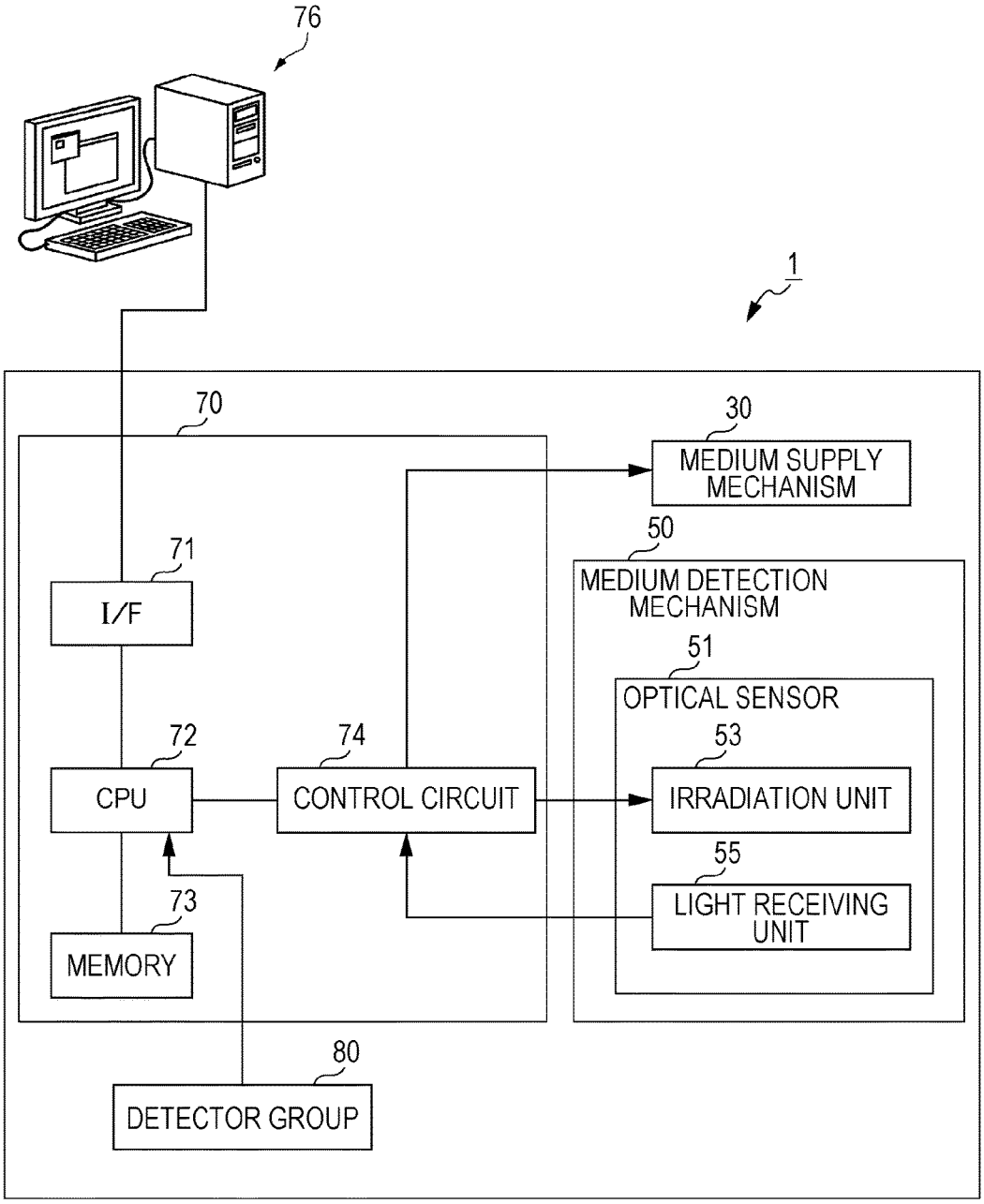
FIG. 7 is a main electric control diagram of the printing apparatus including the medium detection mechanism.

FIG. 7 is a main electric control diagram of the printing apparatus 1 including the medium detection mechanism 50. An electrical configuration of the printing apparatus 1 including the medium detection mechanism 50 will be described with reference to FIG. 7.

A control section 70 is a control section for performing control of the printing apparatus 1. The control section 70 includes a control circuit 74, an interface section 71, a CPU (Central Processing Section) 72, and a memory 73. The interface section 71 performs transmission and reception of data between a computer 76, which is an external apparatus, and the printing apparatus 1. The CPU 72 is an arithmetic processing section for performing input signal processing of signals inputted from a detector group 80 and entire control of the printing apparatus 1. The memory 73 is used as an area to store a program of the CPU 72 and is used as a work area of the CPU 72. The CPU 72 controls the medium supply mechanism 30, the medium detection mechanism 50, and apparatuses not shown in the drawings by the control circuit 74.

The medium detection mechanism 50 has the optical sensor 51 including the irradiation section 53 and the light receiving section 55. The irradiation section 53 is configured to emit irradiation light to the medium guide 31. The light receiving section 55 is configured to receive reflected light that is generated when the irradiation light is reflected by the medium guide 31 or the medium 5 held by the medium guide 31.

Medium Detection Method

Figure 8:
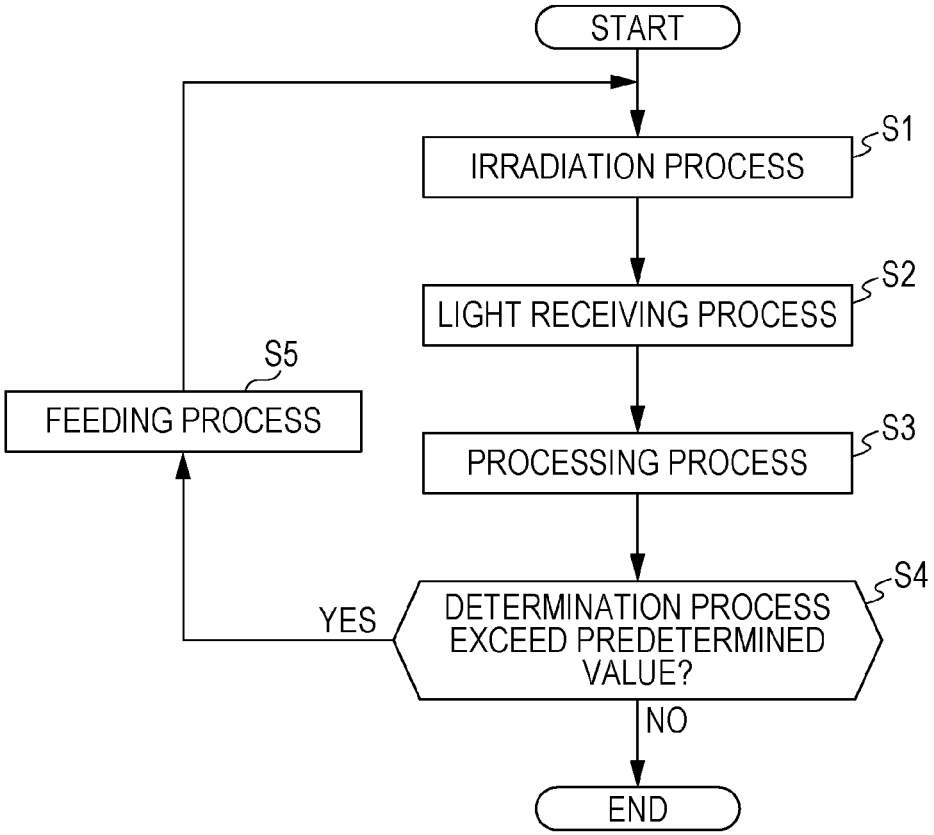
FIG. 8 is a flowchart showing a medium detection method of the medium detection mechanism.

FIG. 8 is a flowchart showing a medium detection method of the medium detection mechanism 50. The medium detection method of the medium detection mechanism 50 included in the printing apparatus 1 will be described with reference to FIGS. 3, 7 and 8.

Step S1 is an irradiation process in which the irradiation light is irradiated from the irradiation section 53. When the control section 70 applies a drive voltage to the irradiation section 53 from the control circuit 74, a light emitting diode (LED) included in the irradiation section 53 emits light, and the irradiation light is emitted from the irradiation section 53 to the medium guide 31. As the irradiation light, for example, it is possible to use an infrared ray or a visible light ray of red or the like.

Step S2 is a light receiving process in which the light receiving section 55 receives the reflected light. When the light receiving section 55 receives the reflected light that is reflected by the medium guide 31 or the medium 5 held by the medium guide 31, the light receiving section 55 outputs a current flowing through a phototransistor included in the light receiving section 55 according to the amount of received light.

Step S3 is a processing process in which the output from the light receiving section 55 is processed. The control section 70 converts the current outputted from the light receiving section 55 into a voltage by using the control circuit 74. In the control circuit 74, a voltage according to the amount of received light that is received by the light receiving section 55 is generated.

Step S4 is a determination process to determine the presence or absence of the medium 5. The CPU 72 compares a voltage outputted from the control circuit 74 and a predetermined value that is stored in the memory 73 in advance and determines whether or not the outputted voltage exceeds the predetermined value. When the outputted voltage exceeds the predetermined value (S4: Yes), the CPU 72 determines that "there is a medium", and proceeds to step S5. When the outputted voltage is lower than or equal to the predetermined value (S4: No), the CPU 72 determines that "there is no medium", and ends detection of the medium 5.

Step S5 is a feeding process to feed the medium 5 to the recording section 20. The control section 70 drives the medium supply mechanism 30, feeds the medium 5 held by the medium guide 31 to the recording section 20, and repeats steps S1 to S4.

In the embodiment, although the medium detection mechanism 50 included in the printing apparatus 1 is exemplified, the medium detection mechanism is not limited to this. The medium detection mechanism 50 may be included in a copy machine, a facsimile, a multifunction machine having a print function, and the like. In the embodiment, although a configuration in which the control section 70 converts the current outputted from the light receiving section 55 into a voltage by using the control circuit 74 is exemplified, the control section 70 is not limited to this. The control section 70 may use the current value itself outputted from the light receiving section 55 in the control circuit 74 as a comparison parameter.

As described above, according to the medium detection mechanism 50 and the printing apparatus 1 according to the embodiment, it is possible to obtain the effects described below. The medium detection mechanism 50 emits irradiation light from the irradiation section 53 to the medium guide 31, receives the reflected light that is reflected by the medium 5 held by the medium guide 31 or the surface of the medium guide 31 by using the light receiving section 55, and determines that "there is a medium" when the amount of received light exceeds a predetermined value. The medium detection mechanism 50 is provided with the optical sensor 51 (the light receiving section 55) at a position where the regular reflected light of external light is not received. Thereby, in a state in which the medium 5 is not held by the medium guide 31, it is possible to prevent the medium 5 from being erroneously detected as a result that the light receiving section 55 receives the regular reflected light of external light which is reflected by the medium guide 31.

The surface of the medium guide 31 is a glossy surface where gloss processing is applied, so that the amount of light of the diffused reflected light of the external light is reduced. Thereby, in a state in which the medium 5 is not held by the medium guide 31, it is possible to reduce the possibility that the medium 5 is erroneously detected as a result that the light receiving section 55 receives the diffused reflected light of external light which is reflected by the medium guide 31. The medium detection mechanism 50 can improve the detection accuracy of the medium 5 by setting the predetermined value between the amount of received light of the diffused reflected light reflected by the surface of the medium guide 31 and the amount of received light of the diffused reflected light reflected by the surface of the medium 5. Therefore, it is possible to provide the medium detection mechanism 50 where the detection accuracy of the medium is improved. Further, the printing apparatus 1 includes the medium detection mechanism 50 where the detection accuracy of the medium 5 is improved, so that it is possible to provide the printing apparatus 1 where the detection accuracy of the medium 5 is improved.

Further, according to the medium detection method according to the embodiment, it is possible to obtain the effects described below. In the medium detection method, the irradiation section 53 of the optical sensor 51 emits the irradiation light to the medium guide 31 that holds the medium 5, the light receiving section 55 receives the reflected light that is reflected by the medium guide 31 or the medium 5 held by the medium guide 31, and the amount of received light of the received reflected light is processed as a voltage. Then, the voltage and a predetermined value that is a threshold value to determine the presence or absence of the medium are compared. When the voltage is greater than the predetermined value, it is determined that "there is a medium", and when the voltage is smaller than or equal to the predetermined value, it is determined that "there is no medium".

The medium detection mechanism 50 includes a medium guide applied a gloss processing that reduces the diffused reflected light and an optical sensor 51 (the light receiving section 55) provided at a position where the regular reflected light of external light is not received, and the predetermined value is set between the amount of received light (voltage) of the diffused reflected light of the irradiation light or the external light which are reflected by the surface of the medium guide and the amount of received light (voltage) of the diffused reflected light of the irradiation light or the external light which are reflected by the surface of the medium 5. Thereby, it is possible to improve the detection accuracy of the medium 5. Therefore, it is possible to provide the medium detection method of the medium detection mechanism 50 where the detection accuracy of the medium is improved.

The invention is not limited to the embodiment described above, and various modifications and improvements can be added to the embodiment. A modified example will be described below.

Modified Example

Figure 9:
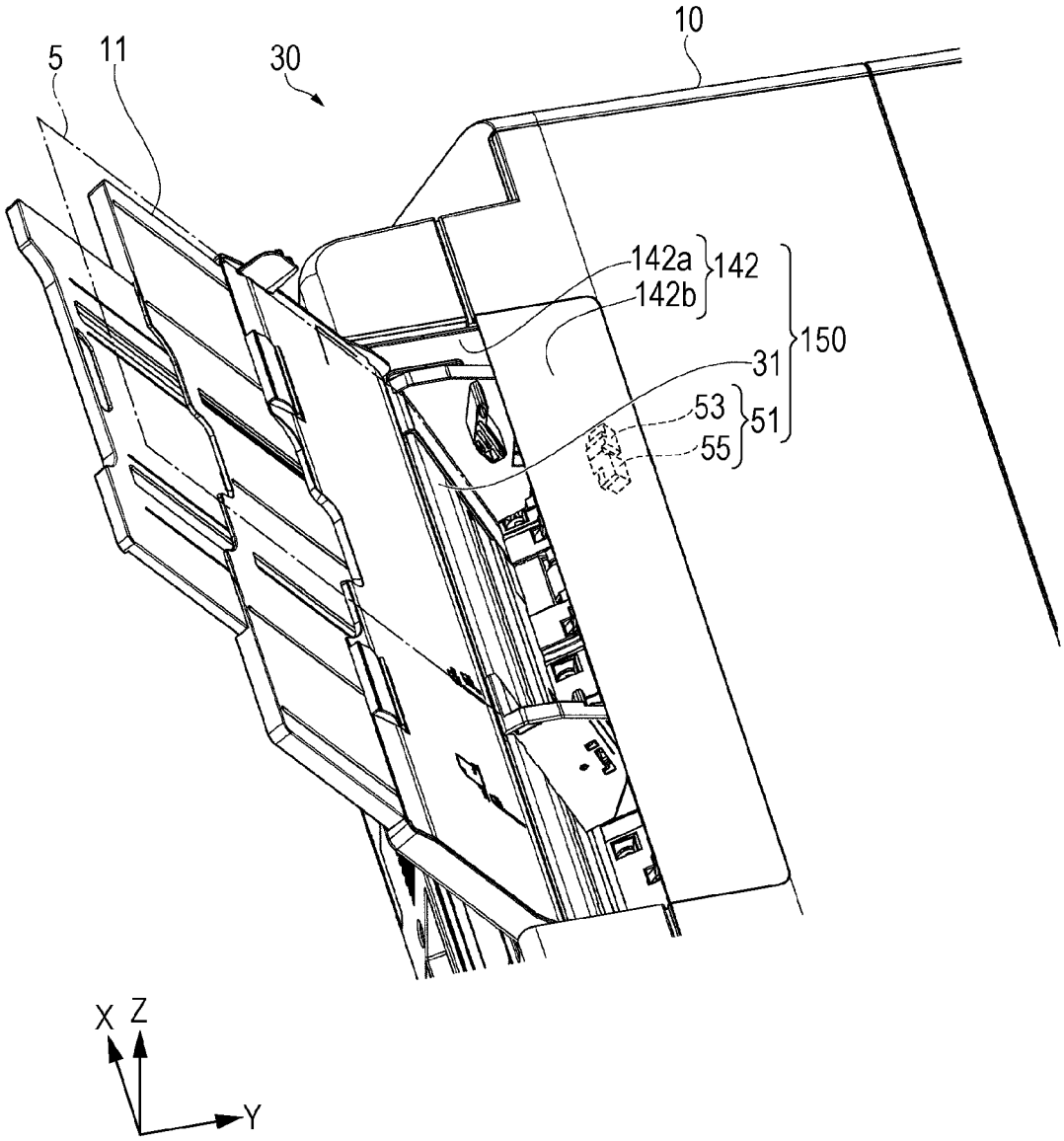
FIG. 9 is a perspective view showing a medium detection mechanism according to a modified example.

FIG. 9 is a perspective view showing a medium detection mechanism 150 according to the modified example. The medium detection mechanism 150 includes a medium guide 31, an optical sensor 51, and a housing 142 that covers the optical sensor 51 and at least a part of the medium guide 31. The housing 142 includes a first housing 142*a* having a concave shape and a second housing 142*b* having a lid shape. The second housing 142*b* is connected turnably around both inner walls of ±X axis sides of the first housing 142*a* as turning fulcrums in the +Y axis direction of the insertion slot 19. The second housing 142*b* is formed of a material that blocks or attenuates the external light.

When the medium 5 is inserted from the insertion slot 19 to the medium guide 31, the second housing 142*b* is turned and the insertion slot 19 is opened in order to improve workability of the operation. After the medium 5 has been inserted, the second housing 142*b* is turned and the optical sensor 51 and at least a part of the medium guide 31 are covered by the second housing 142*b* in order to reduce external light that enters inside the housing 142.

As described above, according to the medium detection mechanism 150 according to the modified example, it is possible to obtain the effect described below. The medium detection mechanism 150 includes the housing 142 that covers the optical sensor 51 and at least a part of the medium guide 31. When detecting a medium, the housing 142 covers the optical sensor 51 and at least a part of the medium guide 31, so that it is difficult for the external light to enter inside the housing 142. Thereby, in a state in which the medium 5 is not held by the medium guide 31, the amount of received light that is received by the light receiving section 55 reduces due to the diffused reflected light of external light which is reflected by the medium guide 31, so that it is possible to improve the detection accuracy of the medium 5.

Hereinafter, the invention will be further specifically described with reference to a practical example. The invention is not limited to the practical example described below.

Test Example

A test for measuring the amount of received light that is received by the light receiving section 55 is performed by variously changing the state of the surface on the medium guide 31 and parameters that determine a configuration of the optical sensor 51 with respect to the medium guide 31 based on the configurations shown in FIGS. 5A to 5C and 6B. Specific conditions and configuration will be described below.

Test Environment

Regarding the test environment, measurement is performed under a uniform condition where the ambient brightness is 500 1×.

State of Surface (Type of Surface) Facing Optical Sensor 51

Regarding the type of surface, the measurement is performed for the glossy surface 31*a* that is easy to regularly reflect light, the embossed surface 31*b* that is easy to diffusingly reflect light, and the surface (paper surface) 31*c* of the medium 5.

Parameters that Determine Configuration of Optical Sensor 51 with Respect to Medium Guide 31

The measurement is performed by variously changing the distance L [mm] of the optical sensor 51 with respect to the medium guide 31 and the angle α [deg] of the optical sensor 51 with respect to the medium guide 31 based on the configuration shown in FIG. 6B.

The optical sensor 51 detects a state of an object to be detected when light emitted from the irradiation section 53 is reflected by the object to be detected and the light receiving section 55 receives the reflected light. In the embodiment, the measurement is performed by using an optical sensor where a current value I [μA] varies according to the amount of received light that is received by the light receiving section 55. In the test example, as the optical sensor 51, a sensor of model number PSR11EL6-D made by KODENSHI CORP. is employed. The result is shown in Table.

A comparative examination between the glossy surface and the paper surface is performed. As obvious from Table, the current values in the case of the glossy surface are much smaller than those in the case of the paper surface, so that it is possible to detect the presence of absence of the medium by using the magnitude relation. Specifically, when L=50 mm and α=−15.4 deg, while a current value of 5.1 μA is outputted in the glossy surface, a current value of 63.4 μA is outputted in the paper surface. Therefore, it is possible to set 5.1 μA as a threshold value and to determine that "there is no medium" when the current value is smaller than or equal to 5.1 μA and determine that "there is a medium" when the current value is greater than 5.1 μA.

A comparative examination between the embossed surface whose surface shape is rougher than that of the glossy surface and the paper surface is performed. As obvious from Table, the current values in the case of the embossed surface are much smaller than those in the case of the paper surface, so that it is possible to detect the presence of absence of the medium by using the magnitude relation. Specifically, when L=50 mm and α=−15.4 deg, while a current value of 7.5 μA is outputted in the embossed surface, a current value of 63.4 μA is outputted in the paper surface. Therefore, it is possible to set 7.5 μA as a threshold value and to determine that "there is no medium" when the current value is smaller than or equal to 7.5 μA and determine that "there is a medium" when the current value is greater than 7.5 μA.

TABLE

| Area | L [mm] | α [deg] | I [μA] | Area | L [mm] | α [deg] | I [μA] | Area | L [mm] | α [deg] | I [μA] |
|---|---|---|---|---|---|---|---|---|---|---|---|
| Gloss | 50 | −15.4 | 5.1 | Emboss | 50 | −15.4 | 7.5 | Paper surface | 50 | −15.4 | 63.4 |
| | | −17.0 | 2.8 | | | −17.0 | 5.4 | | | −17.0 | 63.9 |
| | | −18.6 | 1.7 | | | −18.6 | 3.3 | | | −18.6 | 63.9 |
| | | −20.2 | 1.2 | | | −20.2 | 2.5 | | | −20.2 | 65.0 |
| | | −21.8 | 1.0 | | | −21.8 | 2.0 | | | −21.8 | 62.8 |
| | | −23.3 | 0.9 | | | −23.3 | 1.7 | | | −23.3 | 63.7 |
| | | −24.8 | 0.8 | | | −24.8 | 1.4 | | | −24.8 | 65.3 |
| | 70 | −15.4 | 2.5 | | 70 | −15.4 | 2.9 | | 70 | −15.4 | 26.6 |
| | | −17.0 | 1.3 | | | −17.0 | 2.3 | | | −17.0 | 26.7 |
| | | −18.6 | 0.8 | | | −18.6 | 1.8 | | | −18.6 | 27.6 |
| | | −20.2 | 0.6 | | | −20.2 | 1.2 | | | −20.2 | 27.7 |
| | | −21.8 | 0.5 | | | −21.8 | 1.3 | | | −21.8 | 27.0 |
| | | −23.3 | 0.5 | | | −23.3 | 1.1 | | | −23.3 | 27.8 |
| | | −24.8 | 0.5 | | | −24.8 | 1.0 | | | −24.8 | 27.2 |
| | 90 | −15.4 | 1.3 | | 90 | −15.4 | 1.6 | | 90 | −15.4 | 14.9 |
| | | −17.0 | 0.9 | | | −17.0 | 1.4 | | | −17.0 | 14.9 |
| | | −18.6 | 0.5 | | | −18.6 | 1.2 | | | −18.6 | 14.9 |
| | | −20.2 | 0.5 | | | −20.2 | 0.8 | | | −20.2 | 14.9 |
| | | −21.8 | 0.4 | | | −21.8 | 0.9 | | | −21.8 | 14.8 |
| | | −23.3 | 0.4 | | | −23.3 | 0.9 | | | −23.3 | 15.1 |
| | | −24.8 | 0.4 | | | −24.8 | 0.8 | | | −24.8 | 15.1 |

The entire disclosure of Japanese Patent Application No. 2014-196233, filed Sep. 26, 2014 and No. 2015-124484, filed Jun. 22, 2015 are expressly incorporated by reference herein.

What is claimed is:

1. A medium detection mechanism comprising:

a medium guide that holds a medium; and an optical sensor including an irradiation section that emits irradiation light to the medium guide and a light receiving section that receives reflected light of the medium guide or the medium, wherein an amount of received light that is received by the light receiving section from among reflected light of external light that enters the medium guide and reflected light of the irradiation light is smaller than or equal to a predetermined value when the medium is not on the medium guide, and a sensor angle of the optical sensor with respect to the medium is set so as to differ from an angle which maximizes the amount of received light at the light receiving section when there is the medium on the medium guide.

2. The medium detection mechanism according to claim 1, wherein an area where the medium guide is irradiated with the irradiation light and the external light is a glossy surface.

3. The medium detection mechanism according to claim 1, wherein the amount of received light that is received by the light receiving section when the medium is held by the medium guide is greater than that when the medium is not held by the medium guide.

4. The medium detection mechanism according to claim 1, further comprising:

a housing, wherein regular reflected light of the irradiation light irradiated to the medium guide is not emitted to outside of the housing.

5. The medium detection mechanism according to claim 4, wherein the housing covers the optical sensor and at least a part of the medium guide.

6. A printing apparatus comprising:

the medium detection mechanism according to claim 1.

7. A medium detection method of the medium detection mechanism according to claim 1, the medium detection method comprising:

emitting irradiation light from the irradiation section;

receiving reflected light by the light receiving section;

processing output from the light receiving section; and determining presence or absence of a medium.

8. The medium detection mechanism a cording to claim 1, wherein the irradiation section and the light receiving section are intergrally formed.

9. The medium detection mechanism according to claim 1, wherein a first angle of the irradiation section with respect to the medium guide is equal to a second angle of the light receiving section with respect to the medium guide.

10. the medium detection mechanism according to claim 1, further comprising a light-shielding cover disposed between the optical sensor and the medium guide.

11. the medium section mechanism according to claim 1, wherein the predetermined value being set between the amount of received light of diffused reflected light reflected by the surface of the medium guide and the amount of received light of the diffused reflected light reflected by the surface of the medium.

* * * * *